US007718268B2

(12) United States Patent
Guth et al.

(10) Patent No.: US 7,718,268 B2
(45) Date of Patent: May 18, 2010

(54) SOFTENING SILICONE FORMULATIONS FOR TEXTILE FINISHING

(75) Inventors: Winfried Guth, Odenthal (DE); Rainer Idel, Wermelskirchen (DE); Detlev Kierspe, Langenfeld (DE); Friedrich Koch, Köln (DE); Peter Landenberger, Goslar (DE); Helmut-Martin Meier, Ratingen (DE); Horst Lange, Bochum (DE); Roland Wagner, Bonn (DE); Jürgen Krott, Leverkusen (DE); Annette Möller, Leverkusen (DE)

(73) Assignee: Momentive Performance Materials GmbH, Leverkusen (DE)

( * ) Notice: Subject to any disclaimer, the term of this patent is extended or adjusted under 35 U.S.C. 154(b) by 931 days.

(21) Appl. No.: 10/514,931

(22) PCT Filed: May 13, 2003

(86) PCT No.: PCT/EP03/04965

§ 371 (c)(1),
(2), (4) Date: Sep. 2, 2005

(87) PCT Pub. No.: WO03/095735

PCT Pub. Date: Nov. 20, 2003

(65) Prior Publication Data

US 2006/0100396 A1 May 11, 2006

(30) Foreign Application Priority Data

May 14, 2002 (DE) ..... 102 21 521

(51) Int. Cl.
*D06M 15/643* (2006.01)
*C08G 77/46* (2006.01)
*C08G 77/54* (2006.01)

(52) U.S. Cl. ..... 428/447; 252/8.63; 428/452; 516/53; 516/57; 528/25; 528/28

(58) Field of Classification Search ..... None
See application file for complete search history.

(56) References Cited

U.S. PATENT DOCUMENTS

| | | | | |
|---|---|---|---|---|
| 4,921,895 | A | 5/1990 | Schaefer et al. | |
| 5,098,979 | A * | 3/1992 | O'Lenick, Jr. | 528/15 |
| 5,173,201 | A * | 12/1992 | Coffindaffer et al. | 510/522 |
| 5,602,224 | A * | 2/1997 | Vrckovnik et al. | 528/21 |
| 6,242,554 | B1 * | 6/2001 | Busch et al. | 528/28 |
| 6,528,576 | B1 | 3/2003 | Meier et al. | |
| 6,649,692 | B2 * | 11/2003 | Yu et al. | 524/838 |
| 6,852,244 | B2 * | 2/2005 | Egawa et al. | 252/8.61 |
| 7,041,767 | B2 * | 5/2006 | Lange et al. | 528/28 |

FOREIGN PATENT DOCUMENTS

| | | | |
|---|---|---|---|
| DE | 3802622 | A1 | 8/1989 |
| DE | 19960107 | A1 | 6/2001 |
| DE | 10004321 | A1 | 8/2001 |
| EP | 1116813 | A1 | 7/2001 |
| GB | 2201433 | A * | 9/1988 |
| JP | 2-112483 | * | 4/1990 |
| WO | WO 02/10259 | A1 * | 2/2002 |
| WO | 200218528 | A1 | 3/2002 |

OTHER PUBLICATIONS

Abstract for JP 2-112483.*
Brief Statement of Relevance for DE10004321 published Aug. 9, 2001, one page.
Brief Statement of Relevance for WO 2002/10501 published Feb. 7, 2002, one page.

* cited by examiner

*Primary Examiner*—Marc S Zimmer
(74) *Attorney, Agent, or Firm*—Rankin, Hill & Clark LLP

(57) ABSTRACT

The invention concerns novel formulations containing at least one quaternized aminoalkylsiloxane and at least one compound selected among: a) non-ionic hydrophilic surfactant compounds, b) hydrophilic dispersants and c) divalent of trivalent metal salts with inorganic acids. Said formulations are excellent textile softeners for finishing textile structures in accordance with continuous or drawing process and are characterized by particular shearing stability.

24 Claims, No Drawings

SOFTENING SILICONE FORMULATIONS FOR TEXTILE FINISHING

The invention relates to novel formulations based on quaternized aminoalkylsilicones or -siloxanes, to processes for preparing these formulations and to their use as textile assistants for finishing textile materials.

Silicone softeners are used widely for the finishing of textile materials. For the practical use of the silicone softener emulsions, requirements such as storage stability, thermal stability, resistance toward whiteners and other anionic textile assistants, resistance to pH changes and salt addition and against the action of mechanical energy are of central significance. Particularly the stability against the action of mechanical energy, the shear stability or jet stability, often presents silicone softener emulsions with great difficulties under industrial conditions (cf. R. Zyschka, Melliand Textilberichte June 2001, 497).

Microemulsions offer the fundamental advantage of thermodynamic stability. In a multitude of publications, the equilibrium phase behavior is treated as a function of the structure of the oil to be emulsified and/or of the surfactant(s). Likewise systematically studied has been the addition of inorganic salts (cf. M. Kahlweit et al., Langmuir 11[1995], 3382; M. Kahlweit et al., Langmuir 11[1995]). The equilibrium phase behavior of microemulsions of low molecular weight silicones has likewise been investigated (EP-A 774482; H. von Berlepsch et al, Progr. Colloid Polymer Science 111[1998], 107).

With regard to the softening components, combinations of hydrocarbon-based quats with silicone quats (GB-A 1549180) or else silicone polyethers with silicone quats (U.S. Pat. No. 4,921,895) have been proposed.

To improve the hydrophilicity, the widely utilized aminoalkylsiloxanes are increasingly being replaced by polyether-modified aminoalkylsiloxane oils (cf. EP-A 578144).

An additional introduction of alkoxysilyl structures into polyether- and amino-substituted silicones has likewise been proposed (US-A 20020028900).

Finally, true permanently hydrophilic textile softeners based on silicone quats have been disclosed in WO 02/10256, WO 02/10257 and WO 02/10259.

Fine microemulsions of aminoalkylsiloxanes are said to be obtainable in a two-stage process by preparing a concentrate of aminoalkylsiloxane, silicone-insoluble surfactant and a little water with subsequent rapid stirring into water (U.S. Pat. No. 4,620,878).

According to DE-A 3723697, aminosiloxane emulsions are said to become mechanically stable as a result of the use of water-soluble nonionogenic emulsifiers. For extreme shear stresses, as are achieved on modern jet plants, it has been found that the inventions disclosed in DE-A 3723697 are insufficient to prevent deposits in the jet plant and on the textiles to be treated.

According to WO 02/10501, aminofunctional organosilicon compounds are said to become mechanically stable even in jet dyeing machines without using water-soluble nonionogenic emulsifiers. It has been found that the inventions disclosed in WO 02/10501 are likewise not yet sufficient to reliably prevent deposits on differently pretreated textiles.

Mechanical stability of aminosiloxane microemulsions is also said to be achievable by using betaines, optionally in combination with nonionogenic surfactants of the HLB range from 5 to 16 (cf. U.S. Pat. No. 5,573,694; U.S. Pat. No. 5,520,827).

It is known in dyeing technology that complex mixtures which comprise sulfonated alkylnaphthyl derivatives and halogenated hydrocarbons can be utilized as jet-stable dyeing accelerator formulations (U.S. Pat. No. 4,080,166).

Such sulfonated naphthyl derivatives in combination with fatty alcohol ethoxylates have also been proposed for the stabilization of inkjetable formulations (U.S. Pat. No. 6,302,948). The combination of fatty alcohol ethoxylates with pigments of a certain size is likewise said to lead to inkjetable systems (U.S. Pat. No. 6,099,627).

Finally, it is also known that salts of strong acids, e.g. $Al_2(SO4)_3 \times 18\ H_2O$ ensure protonation of cationic dyes in thermal transfer printing pastes but simultaneously impair their stability (cf. U.S. Pat. No. 5,925,701).

It is common to all of the proposals cited that they do not contain any hints to measures by which emulsions or microemulsions of silicone-based textile softeners, preferably aminosiloxanes and quaternized aminoalkylsiloxanes (silicone quats) can be stabilized reliably against the action of high mechanical energy input of the modern jet systems in combination with greatly varying liquor ratios and the influence of varying pretreatment preparations on the fibers. Moreover, the prior art does not disclose any measures by which the simultaneously occurring high foaming tendency (causes stain formation) of textile softener formulations under high mechanical energy input can be restricted.

It is thus an object of the present invention to describe measures by which emulsions or microemulsions of silicon-based textile softeners, preferably quaternized aminoalkylsiloxanes (silicone quats), can be reliably stabilized under the action of high energy input (extremely high shear forces in modern jet systems) in combination with greatly varying liquor ratios, and the influence of varying pretreatment preparations and the foaming tendency can be simultaneously restricted.

It has been found that, surprisingly, this object is achieved by the combination of quaternized aminoalkylsiloxanes with highly hydrophilic nonionogenic interface-active compounds (surfactants) and/or highly hydrophilic dispersants and/or salts of polyvalent cations and optionally further customary formulation agents.

The present invention therefore relates to formulations comprising at least one quaternized aminoalkylsiloxane and at least one compound from the group of a) the hydrophilic, nonionogenic, interface-active compounds, b) the hydrophilic dispersants and c) the salts of di- or trivalent metals with inorganic acids.

Preferred hydrophilic, nonionogenic, interface-active compounds (a) in the context of the invention are substances which lower the surface tension of water to below 45 mN/m. They are in particular compounds modified with ethylene/propylene oxide (EO/PO), optionally unsaturated and/or branched, from the group of the fatty alcohols, fatty acids, alcohols, acids, alkylaryl derivatives, fatty amines, glycerides and sorbitan esters, in each of which the number of EO/PO units is between 15 and 150, the ratio of PO units to EO units being equal to 0.25 or lower than 0.25, and in each of which the number of ethylene oxide units (EO fraction) is greater than or equal to the number of carbon atoms in the non-EO fraction, or are alkyl-polyglycosides, ethylene oxide/propylene oxide copolymers and polyethersiloxanes.

Hydrophilic dispersants (b) in the context of the invention are substances which, when added to water, lower the surface tension to a value between 72 to 45 mN/m.

The preferred compounds (b) are water-soluble polysaccharides such as carboxy-methylcellulose, hydroxyethylcellulose, methylhydroxypropylcellulose or compounds of the formula

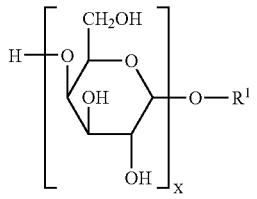

where x is from 1.5 to 20, preferably from 1.5 to 10.

The salts (c) are metal salts having a valency of two or higher, preferably calcium, magnesium and aluminum salts, optionally in the form of their hydrates, with inorganic acids such as hydrochloric acid, sulfuric acid, phosphoric acid. The counterions are to be selected in such a way that sufficient water and formulation solubility is ensured at a given stability of the salt. Examples of such salts are $Ca(Cl)_2$, $Mg(Cl)_2$ and $Al_2(SO_4)_3$, optionally in the form of their hydrates.

Specifically, the compounds (a) are those of the formulae $$R^1—O—[CH_2CH_2O]_q—[CH_2CH(CH_3)O]_r—E, \quad (1)$$

$$R^2—NH—[CH_2CH(CH_3)O]_r—[CH_2CH_2O]_q—E, \quad (3)$$

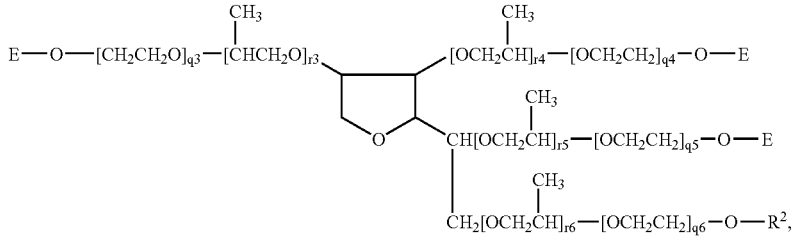

$$R^2—NH—CH(CH_3)CH_2—[OCH_2CH(CH_3)]_m—[OCH_2CH_2]_q—O—E, \quad (6)$$

$$R^2—NH—CH(CH_3)CH_2—[OCH_2CH(CH_3)]_{m7}—[OCH_2CH_2]_q—[OCH_2CH(CH_3)]_{m8}—NH—R^2, \quad (7)$$

$$E—O—[CH_2CH_2O]_s—[CH_2CH(CH_3)O]_t—E, \quad (8)$$

or a polyethersiloxane (9)

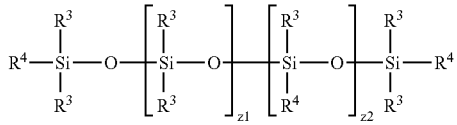

where

E is an $R^1$ radical, hydrogen, straight-chain or branched, saturated or mono- or polyunsaturated $C_1$-$C_{18}$-alkyl which is optionally mono- or polysubstituted by —OH, $C_1$-$C_4$-alkoxy, $C_1$-$C_4$-alkoxycarbonyl or carbonyl, or is $C_5$-$C_{10}$-cycloalkyl which is optionally mono- or polysubstituted by $C_1$-$C_4$-alkyl, —OH, $C_1$-$C_4$-alkoxy, $C_1$-$C_4$-alkoxycarbonyl or carbonyl $R^1$ is straight-chain or branched, saturated or unsaturated $C_8$-$C_{40}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_{10}$-cycloalkyl whose alkyl chain is optionally interrupted singly or multiply by oxygen and/or nitrogen atoms and which is optionally mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, $R^2$ is straight-chain or branched, saturated or mono- to polyunsaturated $C_8$-$C_{40}$-alkyl which is optionally mono- or polysubstituted by —OH, $C_1$-$C_4$-alkoxy, $C_1$-$C_4$-alkoxycarbonyl or carbonyl, $R^3$ is straight-chain or branched $C_1$-$C_{26}$-alkyl or $C_6$-$C_{10}$-aryl, $$—CH_2CH_2—O—[CH_2CH_2O]_q—[CH_2CH(CH_3)O]_r-E, \quad (2)$$

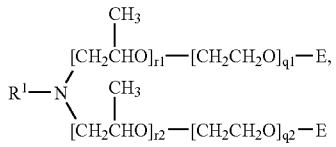

$$(4)$$

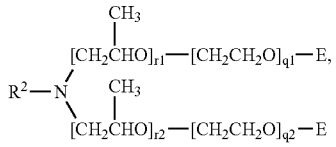

$$(5)$$

$$—CH_2CH_2CH_2—O—[CH_2CH_2O]_q—[CH_2CH(CH_3)O]_r-E$$

$$—CH_2CH_2CH_2—O—CH_2CHOHCH_2—O—[CH_2CH_2O]_q—[CH_2CH(CH_3)O]_r-E$$

$$—Z—[CH_2CH_2O]_q—[CH_2CH(CH_3)O]_r-E$$

where

Z is a straight-chain or branched alkyl or cycloalkyl radical which is in each case interrupted by —O— and/or —CO— and may optionally be substituted by at least one OH group, or

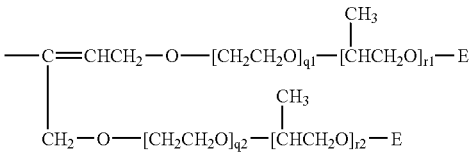

q is from 15 to 150, q1 and q2 are each independently from 0 to 150, where the sum of q1+q2=q, q3, q4, q5 and q6 are each independently from 0 to 150 where the sum of r3+r4+r5+r6=r, and the ratio of r:q≦0.25, m is from 1 to 50, m7 and m8 are each independently from 1 to 50 where 2≦m7+m8 and the sum of m7+m8=m+1, and the ratio of q:m≧4, s is from 5 to 150, t is from 5 to 150 where 0.05≦s:t≦20,

0≦z1≦2000, at least one R4≠R3, and 0.01≦Σ alkyl radicals $R^3$:Σ q+r≦1.

Specifically, the compounds (a) are also those of the formulae (1') to (9')

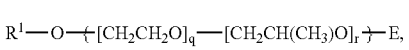

(1')

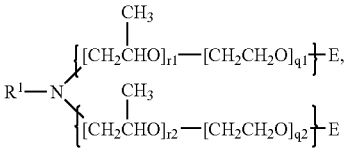

(2')

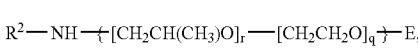

(3')

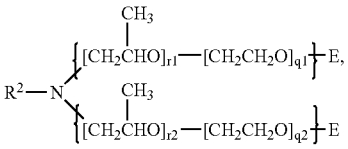

(4')

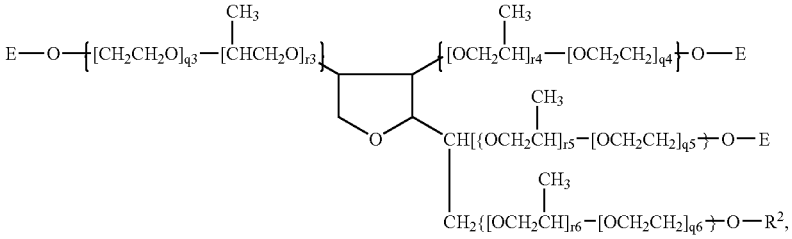

(5')

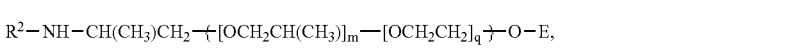

(6')

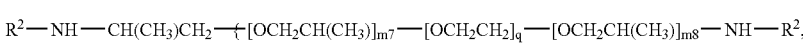

(7')

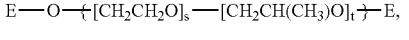

(8')

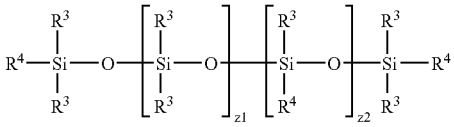

(9')

polyethersiloxane (9')

where the sum of q3+q4+q5+q6=q, r is from 0 to 50, r1 and r2 are each independently from 0 to 50 where the sum of r1+r2=r, r3, r4, r5 and r6 are each independently from 0 to 50 where the brackets "{" and "}" shown in formulae (1')-(8') mean that the ethylene oxide or propylene oxide units within these brackets may either be arranged blockwise as shown or else be in any random distribution, E is an $R^1$ radical, hydrogen, straight-chain or branched, saturated or mono- or polyunsaturated $C_1$-$C_{18}$-alkyl which is optionally mono- or polysubstituted by —OH, $C_1$-$C_4$-alkoxy, $C_1$-$C_4$-alkoxycarbonyl or carbonyl, or is $C_5$-$C_{10}$-cycloalkyl which is optionally mono- or polysubstituted by $C_1$-$C_4$-alkyl, —OH, $C_1$-$C_4$-alkoxy, $C_1$-$C_4$-alkoxycarbonyl or carbonyl, $R^1$ is straight-chain or branched, saturated or unsaturated $C_8$-$C_{40}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_{10}$-cycloalkyl whose alkyl chain is optionally interrupted singly or multiply by oxygen and/or nitrogen atoms and which is optionally mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, or is $C_6$-$C_{10}$-aryl which is optionally substituted, especially by $C_3$-$C_{15}$-alkyl, $R^2$ is straight-chain or branched, saturated or mono- to polyunsaturated $C_8$-$C_{40}$-alkyl which is optionally mono- or polysubstituted by —OH, $C_1$-$C_4$-alkoxy, $C_1$-$C_4$-alkoxycarbonyl or carbonyl, $R^3$ is straight-chain or branched $C_1$-$C_{26}$-alkyl or $C_6$-$C_{10}$-aryl, $R^4$ is $R^3$ or is a radical of the formulae s is from 5 to 150, preferably 15-150, t is from 5 to 150, preferably from 5 to 150 and in particular from 5 to 20, where t:s≦0.25

0≦z1≦2000,

0≦z2≦2000, at least one R4≠R3, and for formula (9'):

$$0.01 \leqq \Sigma \text{ alkyl radicals } R^3 : \Sigma\, q+r \leqq 1.$$

In particular, the compounds (a) are those of the formulae (1) to (9) where

E is hydrogen, straight-chain or branched, saturated or mono- or polyunsaturated $C_1$-$C_4$-alkyl which is optionally mono- to disubstituted by —OH, $C_1$-$C_4$-alkoxy, $C_1$-$C_4$-alkoxycarbonyl or carbonyl, or is $C_5$-$C_6$-cycloalkyl which is in each case optionally mono- or polysubstituted by $C_1$-$C_4$-alkyl, —OH, $C_1$-$C_4$-alkoxy, $C_1$-$C_4$-alkoxycarbonyl or carbonyl, $R^1$ is straight-chain or branched, saturated or unsaturated $C_{10}$-$C_{36}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_6$-cycloalkyl $$-CH_2CH_2-O-(CH_2CH_2O)_q-(CH_2CH(CH_3)O)_r-E,\quad -CH_2CH_2CH_2-O-(CH_2CH_2O)_q-(CH_2CH(CH_3)O)_r-E$$

$$-CH_2CH_2CH_2-O-CH_2CHOHCH_2-O-(CH_2CH_2O)_q-(CH_2CH(CH_3)O)_r-E\quad -Z-(CH_2CH_2O)_q-(CH_2CH(CH_3)O)-E$$

where

Z is a straight-chain or branched alkyl or cycloalkyl radical which is in each case interrupted by —O— and/or —CO— and may optionally be substituted by at least one OH group or

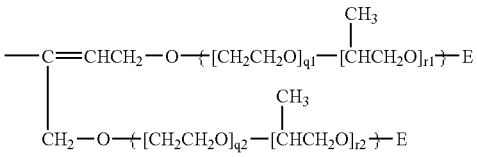

where the brackets "{" and "}" shown in the aforementioned formulae again mean that the ethylene oxide or propylene oxide units within these brackets may either be arranged blockwise as shown or else may be in any random distribution, q is from 15 to 150, q1 and q2 are each independently from 0 to 150 where the sum of q1+q2=q, q3, q4, q5 and q6 are each independently from 0 to 150 where the sum of q3+q4+q5+q6=q, r is from 0 to 50, r1 and r2 are each independently from 0 to 50 where the sum of r1+r2=r, where the sum of r3+r4+r5+r6=r, and the ratio of r:q≦0.25, m is from 1 to 50, m7 and m8 are each independently from 1 to 50 where 2≦m7+m8 and the ratio of q:m≧4, whose alkyl chain is optionally interrupted singly or multiply by oxygen and/or nitrogen atoms and which is optionally mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, $R^2$ is straight-chain or branched, saturated or mono- to polyunsaturated $C_{10}$-$C_{36}$-alkyl which is optionally mono- or polysubstituted by —OH, $C_1$-$C_4$-alkoxy, $C_1$-$C_4$-alkoxycarbonyl or carbonyl, $R^3$ is straight-chain or branched $C_1$-$C_{18}$-alkyl or $C_6$-$C_{10}$-aryl, $R^4$ is an $R^3$ radical or is a radical of the formulae or $$-CH_2CH_2CH_2-O-[CH_2CH_2O]_q-[CH_2CH(CH_3)O]_r-E,$$

q is from 20 to 100, q1 and q2 are each independently from 20 to 100 where the sum of q1+q2=q, q3, q4, q5 and q6 are each independently from 20 to 100 where the sum of q3+q4+q5+q6=q, r is from 0 to 20, r1 and r2 are each independently from 0 to 20 where the sum of r1+r2=r, r3, r4, r5 and r6 are each independently from 0 to 20 where the sum of r3+r4+r5+r6=r, and the ratio of r:q≦0.25, m is from 1 to 7, m7 and m8 are each independently from 1 to 7 where 2≦m7+m8 and the sum of m7+m8=m+1, and the ratio of q:m≧4, s is from 5 to 100, t is from 5 to 100 where 0.05≦s:t≦20,

0≦z1≦2000, $0 \leqq z2 \leqq 2000$, at least one R4≠R3, and and $0.01 \leqq \Sigma$ alkyl radicals $R^3$:$\Sigma$ q+r$\leqq$0.5.

In particular, the compounds (a) are those of the formulae (1') to (9') where

E is hydrogen, straight-chain or branched, saturated or mono- or polyunsaturated $C_1$-$C_4$-alkyl which is optionally mono- to disubstituted by —OH, $C_1$-$C_4$-alkoxy, $C_1$-$C_4$-alkoxycarbonyl or carbonyl, or is $C_5$-$C_6$-cycloalkyl which is in each case optionally mono- or polysubstituted by $C_1$-$C_4$-alkyl, —OH, $C_1$-$C_4$-alkoxy, $C_1$-$C_4$-alkoxycarbonyl or carbonyl, $R^1$ is straight-chain or branched, saturated or unsaturated $C_{10}$-$C_{36}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_6$-cycloalkyl whose alkyl chain is optionally interrupted singly or multiply by oxygen and/or nitrogen atoms and which is optionally mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, or is $C_6$-$C_{10}$-aryl which is optionally substituted, especially by $C_3$-$C_{15}$-alkyl, $R^2$ is straight-chain or branched, saturated or mono- to polyunsaturated $C_{10}$-$C_{36}$-alkyl which is optionally mono- or polysubstituted by —OH, $C_1$-$C_4$-alkoxy, $C_1$-$C_4$-alkoxycarbonyl or carbonyl, $R^3$ is straight-chain or branched $C_1$-$C_{18}$-alkyl or $C_6$-$C_{10}$-aryl, $R^4$ is an $R^3$ radical or is a radical of the formulae $$—CH_2CH_2—O—(—[CH_2CH_2O]_q—[CH_2CH(CH_3)O]_r—)—E, \text{ or}$$

$$—CH_2CH_2CH_2—O—(—[CH_2CH_2O]_q—[CH_2CH(CH_3)O]_r—)—E$$

q is from 20 to 100, q1 and q2 are each independently from 20 to 100 where the sum of q1+q2=q, q3, q4, q5 and q6 are each independently from 20 to 100 where the sum of q3+q4+q5+q6=q, r is from 0 to 20, r1 and r2 are each independently from 0 to 20 where the sum of r1+r2=r, r3, r4, r5 and r6 are each independently from 0 to 20 where the sum of r3+r4+r5+r6=r, and the ratio of r:q$\leqq$0.25, m is from 1 to 7, m7 and m8 are each independently from 1 to 7 where $2 \leqq$m7+m8 and the ratio of q:m$\geqq$4, s is from 5 to 100, preferably from 15 to 100 t is from 5 to 100, preferably from 5 to 20 where t:s$\leqq$0.25, $0 \leqq z1 \leqq 2000$, $0 \leqq z2 \leqq 2000$, at least one R4≠R3, and for the formula (9'):

$$0.01 \leqq \Sigma \text{ alkyl radicals } R^3 : \Sigma\, q \leqq 0.5.$$

The compounds (a) are more preferably those of the formulae (1) to (9) where

E is H—, $CH_3$—, $CH_3CH_2$—, $CH_3CH_2CH_2$—, $(CH_3)_2CH$—, $CH_3CH_2CH_2CH_2$— or $CH_3C(O)$—

$R^1$ is a radical of the formulae

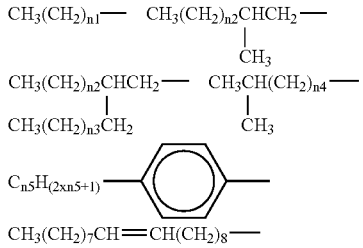

where n1=from 9 to 23, n2=from 3 to 23, n3=from 0 to 18, n4=from 7 to 23, n5=from 3 to 15, $R^2$ is a radical of the formulae

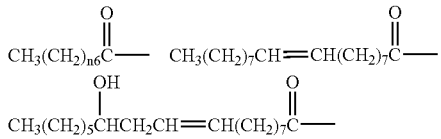

where n6=8 to 28, $R^3$ is $C_1$-$C_{18}$-alkyl or $C_6$-$C_{10}$-aryl, $R^4$ is an $R^3$ radical or is a radical of the formulae $$—CH_2CH_2—O—[CH_2CH_2O]_q—[CH_2CH(CH_3)O]_r—E,$$

or $$—CH_2CH_2CH_2—O—[CH_2CH_2O]_q—[CH_2CH(CH_3)O]_r—E$$

q is from 25 to 60, q1 and q2 are each independently from 25 to 60 q3, q4, q5 and q6 are each independently from 25 to 60 where the sum of q3+q4+q5+q6=q, r is from 0 to 10, r1 and r2 are each independently from 0 to 10 where the sum of r1+r2=r, r3, r4, r5 and r6 are each independently from 0 to 10, where the sum of r3+r4+r5+r6=r, and the ratio of r:q$\leqq$0.25, and $0.01 \leqq \Sigma$ alkyl radicals $R^3$:$\Sigma$ q+r$\leqq$0.1.

The compounds (a) are more preferably also those of the formulae (1') to (9') where E is H—, $CH_3$—, $CH_3CH_2$—, $CH_3CH_2CH_2$—, $(CH_3)_2CH$—, $CH_3CH_2CH_2CH_2$— or $CH_3C(O)$—

$R^1$ is a radical of the formulae

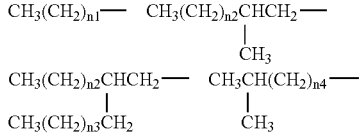

-continued

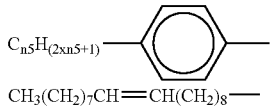

where n1=from 9 to 23, n2=from 3 to 23, preferably from 6 to 23 n3=from 0 to 18, where, preferably, n2+n3≦31, n4=from 7 to 23, n5=from 3 to to 15, $R^2$ is a radical of the formulae

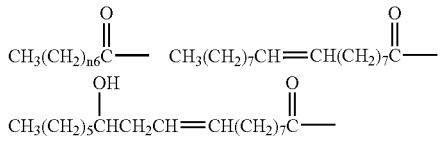

where n6=8 to 28, $R^3$ is $C_1$-$C_{18}$-alkyl or $C_6$-$C_{10}$-aryl, $R^4$ is an $R^3$ radical or is a radical of the formulae

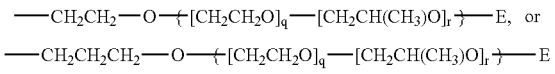

q is from 25 to 60, q1 and q2 are each independently from 25 to 60 q3, q4, q5 and q6 are each independently from 25 to 60 where the sum of q3+q4+q5+q6=q, r is from 0 to 10, r1 and r2 are each independently from 0 to 10 where the sum of r1+r2=r, r3, r4, r5 and r6 are each independently from 0 to 10 where the sum of r3+r4+r5+r6=r, and the ratio of r:q≦0.25, and for the formula (9'):

$$0.01 \leqq \Sigma \text{ alkyl radicals } R^3 : \Sigma\, q \leqq 0.1.$$

Very particular preference is given to inventive formulations which comprise, as compound (a), the ester of stearic acid and 40 mol of EO.

The inventive formulations comprise at least one aminoalkylsiloxane compound quaternized on the nitrogen (silicone quat). Such compounds and their preparation are known, for example, from WO 02/10 256, WO 02/10 257, WO 02/10 259, EP 282 720, EP 17 121, DE-A 100 36 533, DE-A 100 36 539, DE-A 100 36 532, DE-A 100 36 522 and DE-A 102 12 470.

The quaternized aminoalkylsiloxane compounds present in the inventive formulations preferably correspond to linear or cyclic polysiloxane polymers of WO 02-10259 having repeating essential structural units of the formulae (10) and (11)

(10)

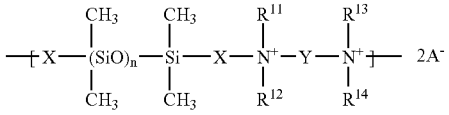

(11)

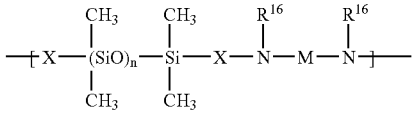

where

X is a divalent hydrocarbon radical having at least 4 carbon atoms which may have a hydroxyl group, preferably has a hydroxyl group, and which may be interrupted by one oxygen atom, and the X groups in the repeating units may be the same or different, Y is a divalent hydrocarbon radical having at least 2 carbon atoms which has a hydroxyl group and which may be interrupted by one or more oxygen or nitrogen atoms, $R^{11}$, $R^{12}$, $R^{13}$ and $R^{14}$ are the same or different and are each alkyl radicals having from 1 to 4 carbon atoms or benzyl radicals, or the $R^{11}$ and $R^{13}$ or $R^{12}$ and $R^{14}$ radicals may in each case be constituents of a bridging alkylene radical, $R^{16}$ is H or an alkyl radical having from 1 to 20 carbon atoms which may be oxygen-substituted, M is the structure —B—O-$(EOx)_v(POx)_w$-B—, where EOx is an ethylene oxide unit and POx is a propylene oxide unit, B is straight-chain or branched $C_2$-$C_6$-alkylene, v is from 0 to 200, w is from 0 to 200, $$v+w \geqq 1,$$

n is from 2 to 1000 where the n in the repeating units may be the same or different, A− is an inorganic or organic anion.

The inventive formulations in some cases also comprise any mixtures of the above-designated quaternized aminoalkylsiloxane compounds with the corresponding nonquaternized compounds. In these nonquaternized compounds, in each case one of the $R^{11}$ or $R^{12}$ radicals or $R^{13}$ or $R^{14}$ radicals in the main chain on the nitrogen atoms in the formula (10) is thus absent.

The quaternized aminoalkylsiloxane compounds which are preferred in accordance with the invention form part of the subject-matter of WO 02/10 259 and are described there generally and specifically. The contents of WO 02/10 259 are incorporated fully by the present application.

In a preferred embodiment of the invention, the amounts of hydrophilic, nonionogenic, interface-active compounds (a) and/or hydrophilic dispersants (b) and/or salts (c) to the amounts of quaternized aminoalkylsiloxane compounds are in a weight ratio Ω of Ω=0.05 to 10, preferably Ω=0.05 to 5, especially Ω=0.05 to 3, very especially Ω=0.05 to 1. Ω illustrates only the ratio of total amount of component (a) to (c) to amount of silicone quat. When the amounts of additive (a) and/or (b) and/or (c) are too small, the effective stabilization in the fiber finishing is exhausted, i.e., for example, that the shear stability under some circumstances cannot always be maintained under strong mechanical shear, high temperatures, long finishing cycles. Very large additive amounts are uneconomic and can change the hand of the textile in an undesired manner.

The additives a) to c) described may be added in two ways. It is possible firstly to introduce the inventive additives directly into the formulations. Secondly, it may be favorable under practice conditions to first dilute the formulations to use concentration and to subsequently add the inventive additives to the liquor prepared.

In addition to components (a) and/or (b) and/or (c), the inventive formulations may also comprise further interface-active components (f) which enable emulsification or micro-emulsification.

These components (f) are customary formulation agents, known to those skilled in the art, for preparing the silicone (micro)emulsions which, however, alone are not stable against high energy input. Such preferred components f1) to f6) include: (f1) oxalkylation products which are obtainable by alkoxylating, with ethylene oxide or propylene oxide, condensation products of phenolic OH-containing aromatics with formaldehyde and NH functional groups. f2) nonionic or ionically modified compounds from the group of the alkoxylates, alkylolamides, esters, amine oxides and alkylpolyglycosides, especially reaction products of alkylene oxides with alkylatable compounds, for example fatty alcohols, fatty amines, fatty acids, phenols, alkylphenols, carboxamides and resin acids. They are, for example, ethylene oxide ethers from the class of the reaction products of ethylene oxide with saturated and/or unsaturated fatty alcohols having from 6 to 25 carbon atoms (commercially available, for example, in the form of Renex® product series) or alkylphenols having from 4 to 12 carbon atoms in the alkyl radical or saturated and/or unsaturated fatty amines having from 14 to 20 carbon atoms or saturated and/or unsaturated fatty acids having from 14 to 22 carbon atoms, or esterification and/or arylation products which are prepared from natural or modified, optionally hydrogenated castor oil fatty substances and are optionally joined to give repeating units by esterification with dicarboxylic acids. f3) ionic or nonionic compounds from the group of the reaction products of alkylene oxide with sorbitan esters [Tween, ICI], oxalkylated acety-lenediols and glycols, oxalkylated phenols, especially phenol/styrene polyglycol ethers. f4) ionic or nonionic polymeric surface-active agents from the group of the homo- and copolymers, graft polymers and graft copolymers and random and linear block copolymers. f5) anionic surface-active agents, for example alkyl sulfates, ether sulfates, ether carboxylates, phosphate esters, sulfosuccinamides, paraffin sulfonates, olefin sulfonates, sarcosinates, isothionates and taurates. f6) amphoteric surface-active agents such as betaines and ampholytes especially glycinates, propionates and imidazolines.

Particularly preferred formulation constituents (f) are alkoxylated fatty alcohols, branched fatty alcohols and fatty acids having from 4 to 14 alkoxy units; very particularly preferred formulation constituents (f) are alkoxylated fatty alcohols, branched fatty alcohols having from 6 to 12 alkoxyl units, especially formulations which contain the ether of tridecyl alcohol with 12 mol of EO, the ether of tridecyl alcohol with 6 mol of EO.

The formulation constituents are generally added in customary amounts to the inventive formulation. Preference is given to adding the components (f) in amounts of from 1 to 200% by weight, preferably from 10 to 80% by weight, more preferably 10-50% by weight, based on the quaternized aminoalkylsiloxane.

In addition to component(s) (a) to (c), the formulations, in each case alone or in combination, and the additives (f) may also comprise further assistants in the amounts customary for these assistants.

Typical assistants in the context of the invention include leveling agents, wetting agents, lustering agents, fiber protection agents, antislip agents and further prior art assistants. A good overview of the inventive assistants can be found in Chwala/Anger, Handbuch der Textilhilfsmittel, Verlag Chemie, Weinhein 1977.

Furthermore, buffer systems may be used to obtain an optimal pH value during the finishing.

To prepare the inventive formulations, the quaternized aminoalkylsiloxane compounds may be mixed with components (a), (b) and/or (c), optionally with addition of further, abovementioned constituents, preferably within a temperature range of from 20 to 90° C., more preferably of from 25 to 70° C., most preferably from 30 to 60° C.

The quaternized aminoalkylsiloxanes are preferably added to the compound(s) (a), (b) and/or (c), particular preference is given to initially charging the quaternized aminoalkylsiloxane (silicone quat) and completing the emulsion formulation by adding the compound(s) (a), (b) and/or (c) and optionally further additives.

The inventive formulations are outstandingly suitable as textile softeners in the finishing of textile structures, especially those made of cotton, keratin fibers, preferably wool, silk or synthetic fibers or, for example, used very efficiently for the finishing of textile structures made of mixtures of cotton with polyester, polyamide, polyacrylonitrile, wool or silk. Excellent results are equally achieved in the finishing of textile structures made of synthetic fibers, especially made of polyester, polyamide, polypropylene or mixtures thereof.

Textile structures are preferably wovens, knits, including formed-loop knits, and nonwovens.

It has been found that the inventive formulations are particularly advantageous for the finishing of cotton or cotton-containing textiles which have been pretreated with anionic lighteners by the jet process.

When the inventive formulations are used, it is possible not only to achieve outstanding softener results but also an improvement in other properties of the textile such as the solubility or an increase in the gloss.

The finishing is generally effected by the continuous process (pad mangle or backwasher process) or by the exhaustion process (jet process). When the inventive formulations are employed by one of these finishing processes, it has been found to be advantageous to maintain the following technological parameters:

Continuous (for Example Pad Mangle, Backwasher)

1. At 11% silicone concentration: 5-50 g/l, preferably 10-40 g/l and especially 10-25 g/l of SQ (=silicone quat) formulation+a) to c)
2. Finishing temperature: Room temperature
3. Drying temperature: 75-105° C. in a forced-air drying cabinet or 10-60 sec on a tenter frame at 150° C., particularly 30-45 sec
4. Time in the forced-air drying cabinet: 10-20 minutes Exhaustion Process (for Example Jet, Winchbeck)

1. At 11% silicone concentration: 1.0-5.0%, preferably 1.5-3.5% and especially 1.5-2.5%
2. Finishing temperature: 30-60° C., preferably 35-50° C. and especially 35-45° C.
3. Heating rate: 2-4° C./minute
4. Finishing time: 15-25 minutes
5. Liquor ratio: from 1:5 to 1:50, particularly from 1:10 to 1:30
6. Drying temperature 75-105° C. in a forced-air drying cabinet or 10-60 sec on a tenter frame at 150° C., particularly 30-45 sec
7. Time in the forced-air drying cabinet: 10-20 minutes

EXAMPLES

In the formulations which follow, a silicone quat (SQ) synthesized according to WO 02/10259, Example 1, was used which had the following structural elements and is prepared as follows:

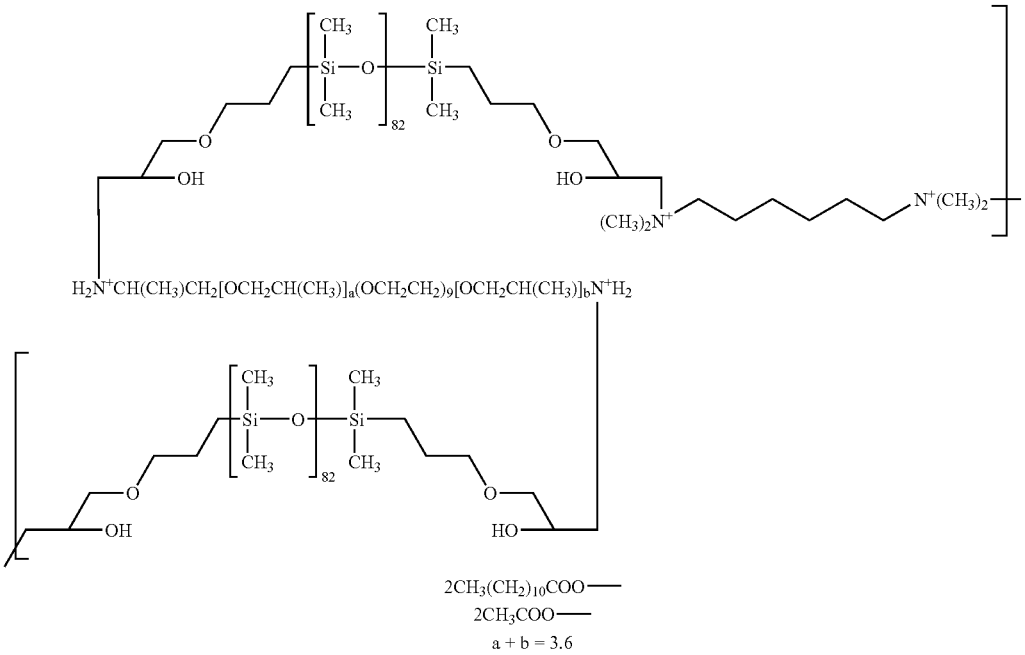

1a) A 1 liter three-neck flask was initially charged at room temperature with 24 g of water and 4.18 g (0.048 mol of tertiary amino groups) of N,N,N',N'-tetramethyl-1,6-hexanediamine and 3.8 g (0.012 mol of primary amino groups) of an alkylene oxide derivative, obtainable under the trade name Jeffamin® ED 600, of the structure $$H_2NCH(CH_3)CH_2[OCH_2CH(CH_3)]_a(OCH_2CH_2)_9[OCH_2CH(CH_3)]_bNH_2$$

where a+b=3.6.

Within 5 minutes, 12.0 g (0.03 mol) of dodecanoic acid in the form of a 50% solution in 2-propanol and 1.8 g (0.03 mol) of acetic acid were added. After the mixture had been heated to 50° C., 194.1 g (0.06 mol of epoxy groups) of an epoxy siloxane of the average composition

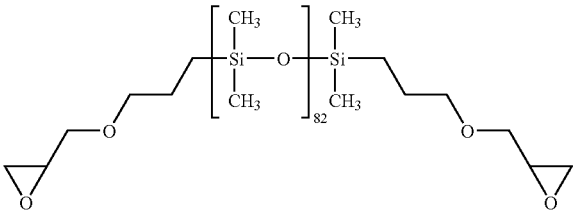

and 30 ml of 2-propanol were added dropwise within 30 minutes. The yellow, opaque mixture was heated to reflux temperature for 6 hours. After removal of all constituents volatile up to 100° C. and at a reduced pressure of 2 mmHg, 204 g of a slightly yellow, opaque material were obtained which contains the following structural elements Starting from this silicone material, three microemulsion concentrates of the following composition were prepared:

| Formulation 1 (F1) | Formulation 2 (F2) | Formulation 3 (F3) |
|---|---|---|
| 430 g SQ | 430 g SQ | 430 g SQ |
| 258 g Renex ® 36 | 125 g Renex ® 36 | 125 g Renex ® 36 |
| 44.5 g Renex ® 30 | 44.5 g Renex ® 30 | 44.5 g Renex ® 30 |
| 10 g acetic acid | 10 g acetic acid | 10 g acetic acid |
| 7.5 g sodium acetate | 7.5 g sodium acetate | 7.5 g sodium acetate |
| 245 g dist. water | 245 g dist. water | 245 g dist. water |
| | 79.5 g 2-Propanol | 79.5 g 2-Propanol |
| | 87.5 g Crodet S40 | 59 g Crodet ® S40 |

These three microemulsion concentrates (about 40% based on SQ) are diluted uniformly with water to 11% silicone quat content in each case. Of these 11% transparent microemulsions, in each case 6 g (absolute amount of silicone quat 0.66 g) are withdrawn, mixed intensively with 6000 ml of water and optionally additives and utilized for jet finishing under the following boundary conditions:

Jet type: Mathis Labor-Jumbo-Jet

Jet pump: Level 6 (highest possible shear)

Amount of water in the jet: 6000 ml

Finishing: 15 minutes at 40° C.

Drying: 80° C.

Textile: 300 g bleached and with optical brightener (e.g. Blankophor® BA treated cotton pullover).

The following table summarizes the results of the finishing experiments.

| No. | Formul. | Additive | Silicone deposition* | Hand after drying** | Hydrophi-licity*** | Foam height in the jet in cm |
|---|---|---|---|---|---|---|
| 1 | F1 | | high deposits, tacky | ok | ok | 12-13 |
| 2 | F1 | 0.39 g Renex ® 36<br>0.06 g Renex ®30 | high deposits, tacky | ok | ok | 12-13 |
| 3 | F1 | 0.5 g $Al_2(SO_4)_3 \cdot 16H_2O$ | no deposits, few defects | ok | ok | 5-6 |
| 4 | F1 | 0.05 g $Al_2(SO_4)_3 \cdot 16H_2O$<br>3 g $MgCl_2 x 6H_2O$ | no deposits, few defects | ok | ok | 5-6 |
| 5 | F2 | | no deposits, no defects | ok | ok | 6-7 |
| 6 | F3 | 0.02 g Crodet ® S40 | no deposits, no defects | ok | ok | 6-7 |
| 7 | F1 | 0.18 g Crodet ® S40 | no deposits, no defects | ok | ok | 6-7 |

*Deposits on glass and steel parts of the jet
**Having a silicone-like softness with volume increase
***Drop absorption time ≦3 seconds
Renex ® 36, trade name of ICI surfactants; tridecyl alcohol-$(EO)_{12}$—OH
Renex ® 30, trade name of ICI surfactants; tridecyl alcohol-$(EO)_6$—OH
Crodet ® S40, trade name of Croda GmbH; stearic acid-$(EO)_{40}$—OH Experiment 1 describes the unacceptable result of a non-inventive prior art experiment. Doubling of the amount of both Renex surfactants does not lead to prevention of deposits (Experiment 2, noninventive).

Experiments 3 and 4 demonstrate that an inventive addition of salts of polyvalent cations can reliably prevent deposits. Aluminum salts are more effective than magnesium compounds.

Experiment 5 shows that an inventive incorporation of hydrophilic interface-active compounds directly into the formulation reliably prevents deposits. It is also true of a likewise inventive partial subsequent addition (Experiment 6) or inventive full addition (Experiment 7) of this hydrophilic interface-active compound.

What is claimed is:

1. A formulation comprising (a) at least one quaternized aminoalkylsiloxane wherein the quaternized aminoalkylsiloxane includes repeating structural units of the formulas (10) or (11)

(10)

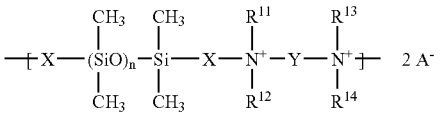

(11)

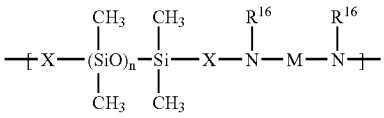

where

X is a divalent hydrocarbon radical having at least 4 carbon atoms which may have a hydroxyl group, preferably has a hydroxyl group, and which may be interrupted by one oxygen atom, and the X groups in the repeating units may the same or different, Y is a divalent hydrocarbon radical having at least 2 carbon atoms which has a hydroxyl group and which may be interrupted by one or more oxygen or nitrogen atoms, $R^{11}$, $R^{12}$, $R^{13}$ and $R^{14}$ are the same or different and are each alkyl radicals having from 1 to 4 carbon atoms or benzyl radicals, or the $R^{11}$ and $R^{13}$ or $R^{12}$ and $R^{14}$ radicals may in each case be constituents of a bridging alkylene radical, R16 is H or an alkyl radical having from 1 to 20 carbon atoms which may be oxygen-substituted, M is the structure —B—O-$(EOx)_v(POx)_w$-B—, where EOx is an ethylene oxide unit and POx is a propylene oxide unit, B is straight-chain or branched $C_2$-$C_6$-alkylene, v is from 0 to 200, w is from 0 to 200, v+w≧1, n is from 2 to 1000 where the n in the repeating units may be the same or different, $A^-$ is an inorganic or organic anion, (b) hydrophilic, nonionogenic, interface-active compounds, wherein the hydrophilic, nonionogenic, interface-active compounds comprise a total of 15 to 150 ethylene oxide and propylene (EG/PO) units, wherein the ratio of PO units to EO units does not exceed 0.25, and wherein the number of ethylene oxide units (EO fraction) is not less than the number of carbon atoms in the non-EO fraction, and wherein the interface active compounds further comprise a moiety selected from the group consisting of fatty alcohols, fatty acids, alkylaryl derivatives, fatty amines, glycerides, and sorbitan esters, and (c) hydrophilic dispersants wherein the hydrophilic dispersants are water-soluble polysaccharides, wherein the hydrophilic, nonionogenic, interface-active compounds have a formula selected from the group consisting of (2) to (7):

(2)

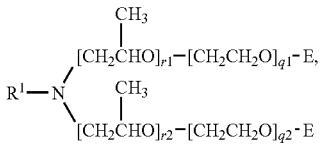

(3)

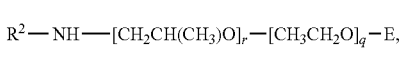

(4)

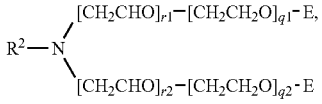

(5)

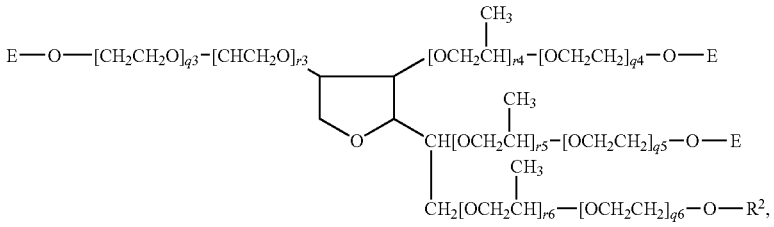

(6)

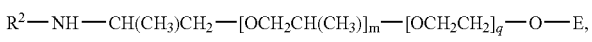

(7)

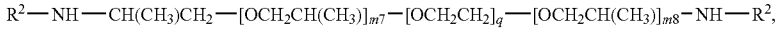

where

E is an $R^1$ radical, hydrogen, straight-chain or branched, saturated or mono- or polyunsaturated $C_1$-$C_{18}$-alkyl which is optionally mono- or polysubstituted by —OH, $C_1$-$C_4$-alkoxy, $C_1$-$C_4$-alkoxycarbonyl or carbonyl, or is $C_5$-$C_{10}$-cycloalkyl which is optionally mono- or polysubstituted by $C_1$-$C_4$-alkyl, —OH, $C_1$-$C_4$-alkoxy, $C_1$-$C_4$-alkoxycarbonyl or carbonyl, $R^1$ is straight-chain or branched, saturated or unsaturated $C_8$-$C_{40}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_{10}$-cycloalkyl whose alkyl chain is optionally singly or multiply by oxygen mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, $R^2$ is straight-chain or branched, saturated or mono- to polyunsaturated $C_8$-$C_{40}$-alkyl which is optionally mono- or polysubstituted by —OH, $C_1$-$C_4$-alkoxy, $C_1$-$C_4$-alkoxycarbonyl or carbonyl, wherein q, q1 and q2 are each independently from 0 to 150, and q=q1+q2, q3, q4, q5 and q6 are each independently from 0 to 150, and q=q3+q4+q5+q6, r, r1 and r2 are each independently from 0 to 50 and r=r1+r2, r3, r4, r5 and r6 are each independently from 0 to 50, and r=r3+r4+r5+r6, the ratio of r:q≦0.25, m is from 1 to 50, m7 and m8 are each independently from 1 to 50 where 2≦m7+m8 and the sum of m7+m8=m+1, and the ratio of q:m≧4.

2. A process for preparing the formulation of claim 1, wherein at least one quaternized aminoalkylsiloxane is mixed with the hydrophilic, nonionogenic, interface-active compounds.

3. The formulation of claim 1, further comprising salts of divalent metals or trivalent metals with inorganic acids.

4. The formulation of claim 3, wherein the salts are selected from the group consisting of the chloride, sulfate and phosphate of a metal selected from the group consisting of calcium, magnesium and aluminum, or hydrates of the foregoing.

5. A textile softener for softening textiles by the continuous or exhaust processes, the softener comprising the formulation of claim 1.

6. A process of finishing textile structures made of one selected from the group consisting of cotton, keratin fibers, wool, silk, synthetic fibers, polyester, polyamide, polyacrylonitrile, polypropylene, or mixtures of the aforementioned types, the process comprising contacting the textile softener of claim 5 with the textile structure.

7. The formulation of claim 1, wherein $A^-$ is an organic anion.

8. A formulation comprising at least one quaternized aminoalkylsiloxane wherein the quaternized aminoalkylsiloxane includes repeating structural units of the formulas (10) or (11)

(10)

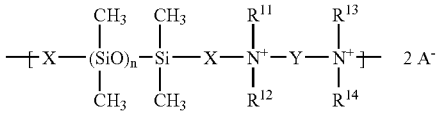

(11)

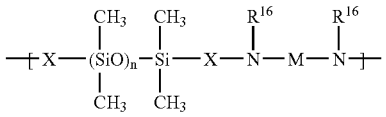

where

X is a divalent hydrocarbon radical having at least 4 carbon atoms which may have a hydroxyl group, preferably has a hydroxyl group, and which may be interrupted by one oxygen atom, and the X groups in the repeating units may the same or different, Y is a divalent hydrocarbon radical having at least 2 carbon atoms which has a hydroxyl group and which may be interrupted by one or more oxygen or nitrogen atoms, $R^{11}$, $R^{12}$, $R^{13}$ and $R^{14}$ are the same or different and are each alkyl radicals having from 1 to 4 carbon atoms or benzyl radicals, or the $R^{11}$ and $R^{13}$ or $R^{12}$ and $R^{14}$ radicals may in each case be constituents of a bridging alkylene radical, $R^{16}$ is H or an alkyl radical having from 1 to 20 carbon atoms which may be oxygen-substituted, M is the structure —B—O-$(EOx)_v(POx)_w$-B—, where EOx is an ethylene oxide unit and POx is a propylene oxide unit, B is straight-chain or branched $C_2$-$C_6$-alkylene, v is from 0 to 200, w is from 0 to 200, $v+w \geqq 1$, n is from 2 to 1000 where the n in the repeating units may be the same or different, $A^-$ is an inorganic or organic anion, and hydrophilic dispersants wherein the hydrophilic dispersants are water-soluble polysaccharides.

9. The formulation of claim 8, wherein the hydrophilic dispersants are selected from the group consisting of carboxymethylcellulose, hydroxyethylcellulose, methylhydroxypropylcellulose or a compound of the formula

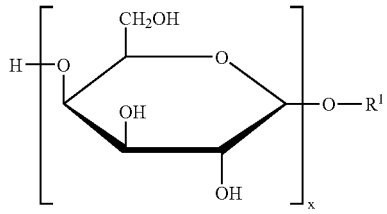

where x is from 1.5 to 20.

10. A textile softener for softening textiles by the continuous or exhaust processes, the softener comprising the formulation of claim 8.

11. A process of finishing textile structures made of one selected from the group consisting of cotton, keratin fibers, wool, silk, synthetic fibers, polyester, polyamide, polyacrylonitrile, polypropylene, or mixtures of the aforementioned types, the process comprising contacting the textile softener of claim 10 with the textile structure.

12. The formulation of claim 8, further comprising hydrophilic, nonionogenic, interface-active compounds which further comprise a total of 15 to 150 ethylene oxide and propylene oxide (EO/PO) units, wherein the ratio of PO units to EO units does not exceed 0.25, and wherein the number of ethylene oxide units (EO fraction) is not less than the number of carbon atoms in the non-EO fraction.

13. The formulation of claim 8, further comprising hydrophilic, nonionogenic, interface-active compounds having a formula selected from the group consisting of (1) to (8):

$$R^1—O—[CH_2CH_2O]_q—[CH_2CH(CH_3)O]_r—E, \quad (1)$$

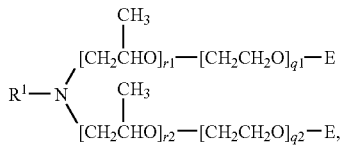

(2)

$$R^2—NH—[CH_2CH(CH_3)O]_r—CH_2CH_2O]_q—E, \quad (3)$$

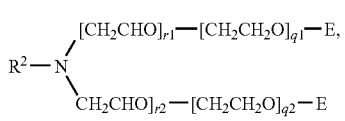

(4)

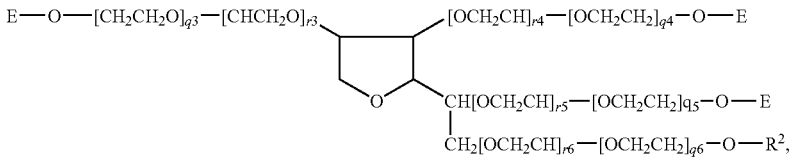

(5)

$$R^2—NH—CH(CH_3)CH_2—[OCH_2CH(CH_3)_m—[OCH_2CH_2]_q—O—E, \quad (6)$$

$$R^2—NH—CH(CH_3)CH_2—[OCH_2CH(CH_3)_{m7}-[OCH_2CH_2]_q—[OCH_2CH(CH_3)]_{m8}-NH—R^2, \quad (7)$$

$$E—O—[CH_2CH_2O]_s—[CH_2CH(CH_3)O]_t—E, \quad (8)$$

and combinations thereof, where

E is an $R^1$ radical, hydrogen, straight-chain or branched, saturated or mono- or polyunsaturated $C_1$-$C_{18}$-alkyl which is optionally mono- or polysubstituted by —OH, $C_1$-$C_4$-alkoxy, $C_1$-$C_4$-alkoxycarbonyl or carbonyl, or is $C_5$-$C_{10}$-cycloalkyl which is optionally mono- or polysubstituted by $C_1$-$C_4$-alkyl, —OH, $C_1$-$C_4$-alkoxy, $C_1$-$C_4$-alkoxycarbonyl or carbonyl $R^1$ is straight-chain or branched, saturated or unsaturated $C_8$-$C_{40}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_{10}$-cycloalkyl whose alkyl chain is optionally singly or multiply by oxygen mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, $R^2$ is straight-chain or branched, saturated or mono- to polyunsaturated $C_8$-$C_{40}$-alkyl which is optionally mono- or polysubstituted by —OH, $C_1$-$C_4$-alkoxy, $C_1$-$C_4$-alkoxycarbonyl or carbonyl, where q, q1 and q2 are each independently from 0 to 150, and q=q1+q2, q3, q4, q5 and q6 are each independently from 0 to 150, and q=q3+q4q5q6, r, r1 and r2 are each independently from 0 to 50 and r=r1+r2, r3, r4, r5 and r6 are each independently from 0 to 50, and r=r3+r4+r5+r6, the ratio of r:q≦0.25, m is from 1 to 50, m7 and m8 are each independently from 1 to 50, where 2≦m7+m8 and the sum of m7+m8=m+1, and the ratio of q:m≧4, s and t are each independently from 5 to 150, where 0.05≦s:t≦20.

14. The formulation of claim 9, wherein $A^-$ is an organic anion.

15. A formulation comprising (a) at least one quaternized aminoalkylsiloxane wherein the quaternized aminoalkylsiloxane includes repeating structural units of the formulas (10) or (11)

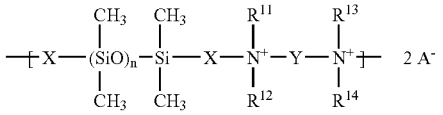

(10)

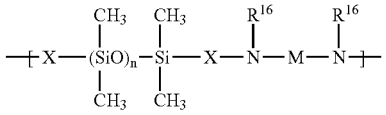

(11)

where

X is a divalent hydrocarbon radical having at least 4 carbon atoms which may have a hydroxyl group, preferably has a hydroxyl group, and which may be interrupted by one oxygen atom, and the X groups in the repeating units may the same or different, Y is a divalent hydrocarbon radical having at least 2 carbon atoms which has a hydroxyl group and which may be interrupted by one or more oxygen or nitrogen atoms, $R^{11}$, $R^{12}$, $R^{13}$ and $R^{14}$ are the same or different and are each alkyl radicals having from 1 to 4 carbon atoms or benzyl radicals, or the $R^{11}$ and $R^{13}$ or $R^{12}$ and $R^{14}$ radicals may in each case be constituents of a bridging alkylene radical, $R^{16}$ is H or an alkyl radical having from 1 to 20 carbon atoms which may be oxygen-substituted, M is the structure —B—O-$(EOx)_v(POx)_w$-B—, where EOx is an ethylene oxide unit and POx is a propylene oxide unit, B is straight-chain or branched $C_2$-$C_6$-alkylene, v is from 0 to 200, w is from 0 to 200, v+w≧1, n is from 2 to 1000 where the n in the repeating units may be the same or different, $A^-$ is an inorganic or organic anion, and (b) hydrophilic, nonionogenic, interface-active compounds, having a formula selected from the group consisting of (1) to (8):

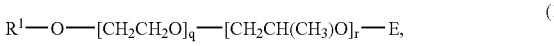

(1)

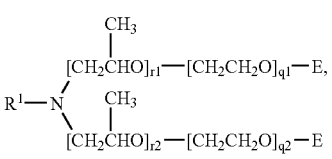

(2)

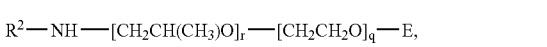

(3)

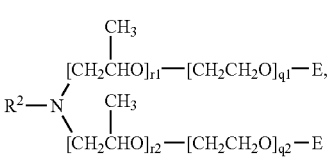

(4)

-continued (5)

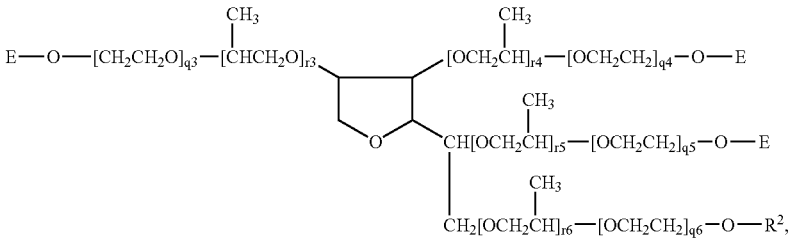

(6)

$$R^2-NH-CH(CH_3)CH_2-[OCH_2CH(CH_3)]_m-[OCH_2CH_2]_q-O-E,$$

(7)

$$R^2-NH-CH(CH_3)CH_2-[OCH_2CH(CH_3)]_{m7}-[OCH_2CH_2]_q-[OCH_2CH(CH_3)]_{m8}-NH-R^2,$$

(8)

$$E-O-[CH_2CH_2O]_s-[CH_2CH(CH_3)O]_t-E,$$

and combinations thereof, wherein

E is hydrogen, straight-chain or branched, saturated or mono- or polyunsaturated $C_1$-$C_4$-alkyl which is optionally mono- to disubstituted by —OH, $C_1$-$C_4$-alkoxy, $C_1$-$C_4$-alkoxycarbonyl or carbonyl, or is $C_5$-$C_6$-cycloalkyl which is in each case optionally mono- or polysubstituted by $C_1$-$C_4$-alkyl, —OH, $C_1$-$C_4$-alkoxy, $C_1$-$C_4$-alkoxycarbonyl or carbonyl, $R^1$ is straight-chain or branched, saturated or unsaturated $C_{10}$-$C_{36}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_6$-cycloalkyl whose alkyl chain is optionally interrupted singly or multiply by oxygen and/or nitrogen atoms and which is optionally mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, $R^2$ is straight-chain or branched, saturated or mono- to polyunsaturated $C_{10}$-$C_{36}$-alkyl which is optionally mono- or polysubstituted by —OH, $C_1$-$C_4$-alkoxy, $C_1$-$C_4$-alkoxycarbonyl or carbonyl, q1 and q2 are each independently from 20 to 100, and q q1+q2, q3, q4, q5 and q6 are each independently from 20 to 100, and q=q3+q4+q5+q6, r, r1, and r2 are each independently from 0 to 20, and r=r1+r2, r3, r4, r5 and r6 are each independently from 0 to 20, and r=r3+r4+r5+r6, the ratio of r:q≦0.25, m, m7 and m8 are each independently from 1 to 7 where 2≦m7+m8 and the sum of m7+m8=m, and the ratio of q:m≧4, s and t are each independently from 5 to 100, where 0.05≦s:t≦20.

16. The formulation of claim 15, wherein

E is H, $CH_3$—, $CH_3CH_2$—, $CH_3CH_2CH_2$—, $(CH_3)_2CH$—, $CH_3CH_2CH_2CH_2$— or $CH_3C(O)$—, $R^1$ is a radical having a formula selected from the group consisting of

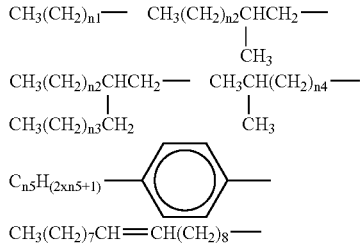

where n1 is from 9 to 23, n2 is from 3 to 23, n3 is from 0 to 18, n4 is from 7 to 23, n5 is from 3 to 15, $R^2$ is a radical having a formula selected from the group consisting of

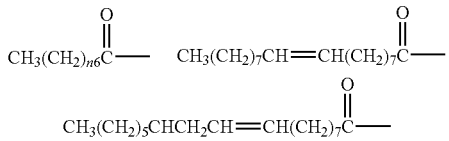

where n6 is from 8 to 28, $R^3$ is $C_1$-$C_{18}$-alkyl or $C_6$-$C_{10}$-aryl, $R^4$ is an $R^3$ radical or is a radical having a formula selected from the group consisting of $$-CH_2CH_2-O-(-[CH_2CH_2O]_q-[CH_2CH(CH_3)O]_r-)-E, \text{ and}$$

$$-CH_2CH_2CH_2-O-(-[CH_2CH_2O]_q-[CH_2CH(CH_3)O]_r-)-E$$

v is from 0 to 200, w is from 0 to 200, v+w≧1, n is from 2 to 1000 where the n in the repeating units may be the same or different, q, q1 and q2 are each independently from 25 to 60 and q=q1+q2, q3, q4, q5 and q6 are each independently from 25 to 60 and q=q3+q4+q5+q6, r, r1 and r2 are each independently from 0 to 10 and r=r1+r2, r3, r4, r5 and r6 are each independently from 0 to 10.

17. The formulation of claim 15, wherein $A^-$ is an organic anion.

18. The formulation of claim 16, wherein $A^-$ is an organic anion.

19. A textile softener for softening textiles by the continuous or exhaust processes, the softener comprising the formulation of claim 15.

20. A process of finishing textile structures made of one selected from the group consisting of cotton, keratin fibers, wool, silk, synthetic fibers, polyester, polyamide, polyacrylonitrile, polypropylene, or mixtures of the aforementioned types, the process comprising (a) pretreating the textile structures with anionic whiteners, (b) contacting a textile softener for softening textiles by the continuous or exhaust processes, the softener comprising a formulation comprising at least one quaternized aminoalkylsiloxane wherein the quaternized aminoalkylsiloxane includes repeating structural units of the formulas (10) or (11)

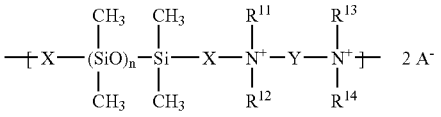

(10)

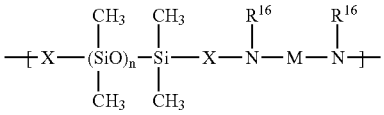

(11)

where

X is a divalent hydrocarbon radical having at least 4 carbon atoms which may have a hydroxyl group, preferably has a hydroxyl group, and which may be interrupted by one oxygen atom, and the X groups in the repeating units may the same or different, Y is a divalent hydrocarbon radical having at least 2 carbon atoms which has a hydroxyl group and which may be interrupted by one or more oxygen or nitrogen atoms, $R^{11}$, $R^{12}$, $R^{13}$ and $R^{14}$ are the same or different and are each alkyl radicals having from 1 to 4 carbon atoms or benzyl radicals, or the $R^{11}$ and $R^{13}$ or $R^{12}$ and $R^{14}$ radicals may in each case be constituents of a bridging alkylene radical, $R^{16}$ is H or an alkyl radical having from 1 to 20 carbon atoms which may be oxygen-substituted, M is the structure —B—O-$(EOx)_v(POx)_w$-B—, where EOx is an ethylene oxide unit and POx is a propylene oxide unit, β is straight-chain or branched $C_2$-$C_6$-alkylene, v is from 0 to 200, w is from 0 to 200, v+w≧1, n is from 2 to 1000 where then in the repeating units may be the same or different, $A^-$ is an inorganic or organic anion and (c) finishing the textile structures in a jet dyeing apparatus.

21. A process of finishing textile structures made of one selected from the group consisting of cotton, keratin fibers, wool, silk, synthetic fibers, polyester, polyamide, polyacrylonitrile, polypropylene, or mixtures of the aforementioned types, the process comprising contacting the textile softener of claim 19 with the textile structure.

22. A formulation comprising:

(a) at least one quaternized aminoalkylsiloxane wherein the quaternized aminoalkylsiloxane includes repeating structural units of the formulas (10) or (11)

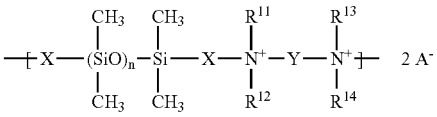

(10)

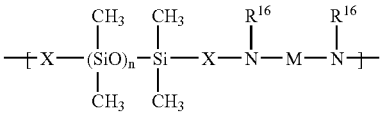

(11)

where

X is a divalent hydrocarbon radical having at least 4 carbon atoms which may have a hydroxyl group, preferably has a hydroxyl group, and which may be interrupted by one oxygen atom, and the X groups in the repeating units may the same or different, Y is a divalent hydrocarbon radical having at least 2 carbon atoms which has a hydroxyl group and which may be interrupted by one or more oxygen or nitrogen atoms, $R^{11}$, $R^{12}$, $R^{13}$ and $R^{14}$ are the same or different and are each alkyl radicals having from 1 to 4 carbon atoms or benzyl radicals, or the $R^{11}$ and $R^{13}$ or $R^{12}$ and $R^{14}$ radicals may in each case be constituents of a bridging alkylene radical, $R^{16}$ is H or an alkyl radical having from 1 to 20 carbon atoms which may be oxygen-substituted, M is the structure —B—O-$(EOx)_v(POx)_w$-B—, where EOx is an ethylene oxide unit and POx is a propylene oxide unit, B is straight-chain or branched $C_2$-$C_6$-alkylene, v is from 0 to 200, w is from 0 to 200, v+w≧1, n is from 2 to 1000 where the n in the repeating units may be the same or different, $A^-$ is an organic anion, (b) hydrophilic, nonionogenic, interface-active compounds, wherein the hydrophilic, nonionogenic, interface-active compounds comprise a total of 15 to 150 ethylene oxide and propylene (EO/PO) units, wherein the ratio of PO units to EO units does not exceed 0.25, and wherein the number of ethylene oxide units (EO fraction) is not less than the number of carbon atoms in the non-EO fraction, and wherein the interface active compounds further comprise a moiety selected from the group consisting of fatty alcohols, fatty acids, alkylaryl derivatives, fatty amines, glycerides, and sorbitan esters, and (c) hydrophilic dispersants wherein the hydrophilic dispersants are water-soluble polysaccharides, wherein the hydrophilic, nonionogenic, interface-active compounds have a formula selected from the group consisting of (1) to (8):

(1)

$$R^1—O—[CH_2CH_2O]_q—[CH_2CH(CH_3)O]_r—E,$$

(2)

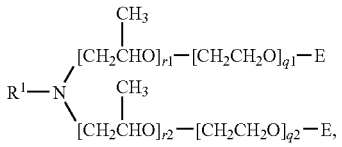

(3)

$$R^2—NH—[CH_2CH(CH_3)O]_r—[CH_2CH_2O]_q—E,$$

(4)

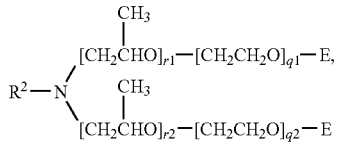

(5)

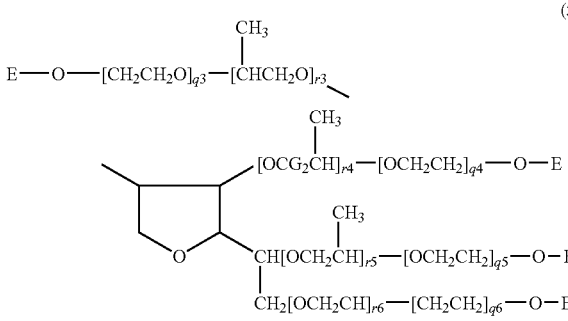

(6)

$$R^2—NH—CH(CH_3)CH_2—[OCH_2CH(CH_3)]_m—[OCH_2CH_2]_q—O—E,$$

(7)

$$R^2—NH—CH(CH_3)CH_2—[OCH_2CH(CH_3)]_{m7}—[OCH_2CH_2]_q—[OCH_2CH(CH_3)]_{m8}—NH—R^2,$$

(8)

$$E—O—[CH_2CH_2O]_s—[CH_2CH_9CH_{30}O]_t—E,$$

and combinations thereof, wherein

E is an $R^1$ radical, hydrogen, straight-chain or branched, saturated or mono- or polyunsaturated $C_1$-$C_{18}$-alkyl which is optionally mono- or polysubstituted by —OH, $C_1$-$C_4$-alkoxy, $C_1$-$C_4$-alkoxycarbonyl or carbonyl, or is $C_5$-$C_{10}$-cycloalkyl which is optionally mono- or polysubstituted by $C_1$-$C_4$-alkyl, —OH, $C_1$-$C_4$-alkoxy, $C_1$-$C_4$-alkoxycarbonyl or carbonyl $R^1$ is straight-chain or branched, saturated or unsaturated $C_8$-$C_{40}$-alkyl whose alkyl chain is optionally interrupted singly or multiply by oxygen and/or nitrogen atoms and which is optionally mono- or polysubstituted by —OH, $C_1$-$C_4$-alkoxy, $C_1$-$C_4$-alkoxycarbonyl or carbonyl, amino, mono- or di-$C_1$-$C_4$-alkylamino, or is $C_5$-$C_{10}$-cycloalkyl whose alkyl chain is optionally singly or multiply by oxygen mono- or polysubstituted by $C_1$-$C_4$-alkyl, —OH, $C_1$-$C_4$-alkoxy, $C_1$-$C_4$-alkoxycarbonyl or carbonyl, amino, mono- or di-$C_1$-$C_4$-alkylamino, $R^2$ is straight-chain or branched, saturated or mono- to polyunsaturated $C_8$-$C_{40}$-alkyl which is optionally mono- or polysubstituted by —OH, $C_1$-$C_4$-alkoxy, $C_1$-$C_4$-alkoxycarbonyl or carbonyl, where q, q1 and q2 are each independently from 0 to 150, and q=q1+q2, q3, q4, q5 and q6 are each independently from 0 to 150, and q=q3+q4+q5+q6, r, r1 and r2 are each independently from 0 to 50 and r=r1+r2, r3, r4, r5 and r6 are each independently from 0 to 50, and r r3+r4+r5+r6, the ratio of r:q≦0.25, m is from 1 to 50, m7 and m8 are each independently from 1 to 50, where 2≦m7+m8 and the sum of m7+m8=m+1, and the ratio of q:m≧4, s and t are each independently from 5 to 150, and 0.05≦s:t≦20.

23. A textile softener for softening textiles by the continuous or exhaust processes, the softener comprising the formulation of claim 22.

24. A process of finishing textile structures made of one selected from the group consisting of cotton, keratin fibers, wool, silk, synthetic fibers, polyester, polyamide, polyacrylonitrile, polypropylene, or mixtures of the aforementioned types, the process comprising contacting the textile softener of claim 23 with the textile structure.

* * * * *

UNITED STATES PATENT AND TRADEMARK OFFICE

CERTIFICATE OF CORRECTION

PATENT NO. : 7,718,268 B2
APPLICATION NO. : 10/514931
DATED : May 18, 2010
INVENTOR(S) : Winfried Guth et al.

It is certified that error appears in the above-identified patent and that said Letters Patent is hereby corrected as shown below:

In the claims, claim 1, column 19, formula 5, should appear as follows:

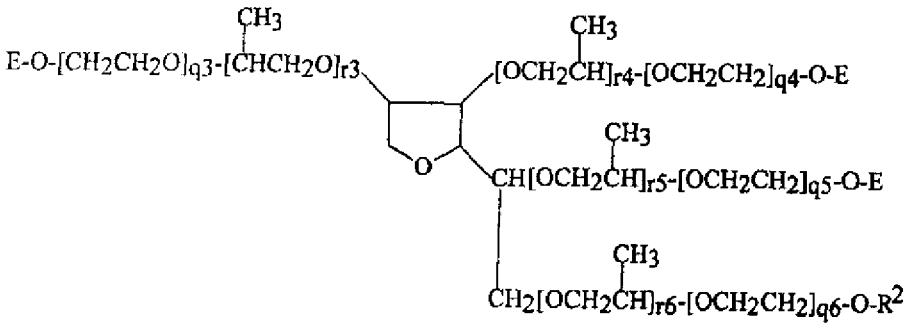

In the claims, claim 13, column 22, formula 5, should appear as follows:

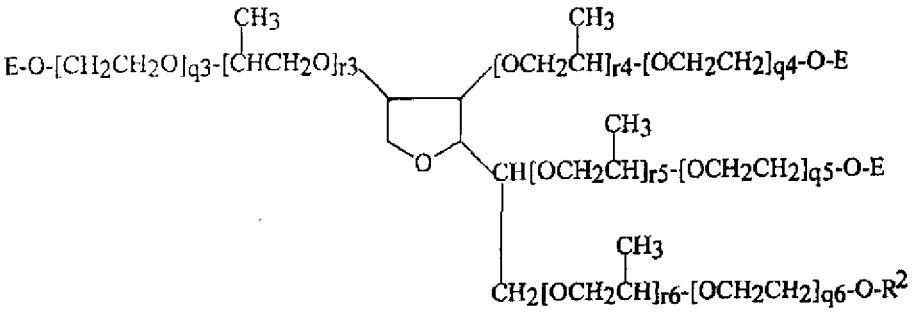

Signed and Sealed this

Twenty-ninth Day of June, 2010

David J. Kappos

David J. Kappos
*Director of the United States Patent and Trademark Office*

In the claims, claim 22, column 29, formula 8, should appear as follows:

$$E\text{-}O\text{-}[CH_2CH_2O]_s\text{-}[CH_2CH(CH_3)O]_t\text{-}E$$